US011060708B2

(12) United States Patent
Chen et al.

(10) Patent No.: US 11,060,708 B2
(45) Date of Patent: Jul. 13, 2021

(54) LIGHTING APPARATUS

(71) Applicant: XIAMEN ECO LIGHTING CO. LTD., Xiamen (CN)

(72) Inventors: Chunteng Chen, Xiamen (CN); Chuntian Qiu, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/858,035

(22) Filed: Apr. 24, 2020

(65) Prior Publication Data

US 2020/0340652 A1 Oct. 29, 2020

(30) Foreign Application Priority Data

Apr. 25, 2019 (CN) ..... 201910337824.0
Apr. 25, 2019 (CN) ..... 201920574344.1

(51) Int. Cl.

| | |
|---|---|
| ***F21V 21/15*** | (2006.01) |
| ***F21S 8/04*** | (2006.01) |
| ***F21S 4/28*** | (2016.01) |
| ***F21V 23/04*** | (2006.01) |
| ***F21V 21/30*** | (2006.01) |
| *F21Y 115/10* | (2016.01) |
| *F21Y 103/10* | (2016.01) |

(52) U.S. Cl.

CPC ..... *F21V 21/15* (2013.01); *F21S 4/28* (2016.01); *F21S 8/04* (2013.01); *F21V 21/30* (2013.01); *F21V 23/0464* (2013.01); *F21Y 2103/10* (2016.08); *F21Y 2115/10* (2016.08)

(58) Field of Classification Search

CPC .. F21S 8/04; F21V 21/15; F21V 21/30; F21V 23/0464

See application file for complete search history.

(56) References Cited

U.S. PATENT DOCUMENTS

| | | | | |
|---|---|---|---|---|
| 9,964,687 | B2 * | 5/2018 | Sekii | G02B 6/0078 |
| 10,180,529 | B2 * | 1/2019 | Ohno | G02B 6/005 |
| 10,655,834 | B1 * | 5/2020 | Kotovsky | F21V 19/0015 |
| 2010/0002426 | A1 * | 1/2010 | Wu | F21V 7/0016 362/223 |
| 2010/0118526 | A1 * | 5/2010 | Chien | F21V 15/013 362/230 |
| 2015/0138829 | A1 * | 5/2015 | Jang | G02B 6/0021 362/606 |

* cited by examiner

*Primary Examiner* — Leah Simone Macchiarolo
(74) *Attorney, Agent, or Firm* — Chun-Ming Shih; Lanway IPR Services

(57) ABSTRACT

A lighting apparatus includes alight base, a middle light body, a first end box, a second end box, a first side light body, a second side light body. The light base has a main body and a center opening located in a middle place of the main body. For example, the light base has a bracket housing. The first end box and the second end box are attached to two opposite ends of the light body. The first side light body is connected to the first end box and the second end box for emitting a first lateral light. The first side light body and the second side light body are rotatable with respect to the first end box and the second end box for adjusting light emitting angles of the first lateral light and the second lateral light.

20 Claims, 21 Drawing Sheets

LIGHTING APPARATUS

FIELD

The present application is related to a lighting apparatus and more particularly related to a lighting apparatus with a wider illuminance range.

BACKGROUND

Electroluminescence, an optical and electrical phenomenon, was discovered in 1907. Electroluminescence refers the process when a material emits light when a passage of an electric field or current occurs. LED stands for light-emitting diode. The very first LED was reported being created in 1927 by a Russian inventor. During decades' development, the first practical LED was found in 1961, and was issued patent by the U.S. patent office in 1962. In the second half of 1962, the first commercial LED product emitting low-intensity infrared light was introduced. The first visible-spectrum LED, which limited to red, was then developed in 1962.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

With high light output, LEDs are available across the visible, infrared wavelengths, and ultraviolet lighting fixtures. Recently, there is a high-output white light LED. And this kind of high-output white light LEDs are suitable for room and outdoor area lighting. Having led to new displays and sensors, LEDs are now be used in advertising, traffic signals, medical devices, camera flashes, lighted wallpaper, aviation lighting, horticultural grow lights, and automotive headlamps. Also, they are used in cellphones to show messages.

A Fluorescent lamp refers to a gas-discharge lamps. The invention of fluorescent lamps, which are also called fluorescent tubes, can be traced back to hundreds of years ago. Being invented by Thomas Edison in 1896, fluorescent lamps used calcium tungstate as the substance to fluoresce then. In 1939, they were firstly introduced to the market as commercial products with variety of types.

In a fluorescent lamp tube, there is a mix of mercury vapor, xenon, argon, and neon, or krypton. A fluorescent coating coats on the inner wall of the lamp. The fluorescent coating is made of blends of rare-earth phosphor and metallic salts. Normally, the electrodes of the lamp comprise coiled tungsten. The electrodes are also coated with strontium, calcium oxides and barium. An internal opaque reflector can be found in some fluorescent lamps. Normally, the shape of the light tubes is straight. Sometimes, the light tubes are made circle for special usages. Also, u-shaped tubes are seen to provide light for more compact areas.

Because there is mercury in fluorescent lamps, it is likely that the mercury contaminates the environment after the lamps are broken. Electromagnetic ballasts in fluorescent lamps are capable of producing buzzing mouse. Radio frequency interference is likely to be made by old fluorescent lamps. The operation of fluorescent lamps requires specific temperature, which is best around room temperature. If the lamps are placed in places with too low or high temperature, the efficacy of the lamps decreases.

In real lighting device design, details are critical no matter how small they appear. For example, it is important to provide a convenient design for users to be able to adjust illuminance areas.

SUMMARY

In some embodiments, a lighting apparatus includes alight base, a middle light body, a first end box, a second end box, a first side light body, a second side light body.

The light base has a main body and a center opening located in a middle place of the main body. For example, the light base has a bracket housing. The bracket housing has a rectangular shape with a center opening.

The middle light body is connected to the light base for emitting a top light passing through the center opening of the light base and for emitting a bottom light in a direction opposite to the top light. For example, the light body is installed close to a ceiling but left with a space. The center opening allows light from the middle body to emit light passing through the center opening and projecting the light on the space forming an indirect luminance light source.

The first end box and the second end box are attached to two opposite ends of the light body. The first side light body is connected to the first end box and the second end box for emitting a first lateral light. The second side light body is connected to the first end box and the second end box for emitting a second lateral light. The first side light body and the second light body are located on two opposite sides of the middle light body.

The first side light body and the second side light body are rotatable with respect to the first end box and the second end box for adjusting light emitting angles of the first lateral light and the second lateral light.

In some embodiments, the middle light body is a light tube with a top surface for passing the top light and with a bottom surface for passing the bottom light.

There are multiple LED modules disposed on an elongated substrate in the light tube for emitting the top light and the bottom light.

In some embodiments, there are two sets of LED modules disposed on opposite sides of the elongated substrate. One set emits the top light and the other set emits the bottom light.

In some embodiments, the first side light body and the second side light body are light tubes with LED modules.

In some embodiments, the first side light body and the second side light body respectively have main light directions, e.g. 120 degrees wide major light output angle.

By rotating the first side light body and/or the second side light body for changing light directions of the first lateral light and the second lateral light ensures more complete or specific areas are illuminated.

In an embodiment, the light base has a conductive path for routing electricity from an external power source to the middle light body. The first side light body and the second side light body.

In some embodiments, a driver circuit is also integrated in the light base. Specifically, an indoor power like a 110V or 220V alternating current is connected to the driver circuit. The driver circuit converts the indoor power to proper direct currents and supplies the direct currents to the middle light body, the first side light body and the second side light body.

In some embodiments, the first end box and the second end box receives electricity from the conductive path of the light base and supply the electricity to the first side light body and the second side light body.

The electricity connection between the first end box and the second end box to the light body is a wireless power transmission.

In some embodiments, the lighting apparatus may also include a plurality of LED light sources disposed at a bottom of the light base.

In some embodiments, in addition to rotate with respect to the first end box and the second end box, the first side light body and the second light body are operable to be moved closer or farther to the middle light body.

For example, there are shifting structures in the first end box and the second end box for moving the first side light body and the second side light body horizontally.

In some embodiments, the lighting apparatus may also include a motor for moving the first side light body and the second side light body when a switch receives a switch command.

The switch command may be a turn-on or a turn-off command. For example, the switch may be a wall switch connects to the lighting apparatus. When users turn on or turn off the wall switch, the wall switch sends the switch command to the light body.

The driver circuit in the light body detects the turn-on or turn-off commands and then automatically drives the motor to move the first side light body and the second side light body to change positions along a predetermined pattern.

For example, when the lighting apparatus is turn-on, the first side light body and the second side body are moved to expand an overall size of the lighting apparatus. Specifically, the first side light body on the left is moved further to left direction and the second side light body on the right is moved further to right direction to expand.

On the other hand, when users turn off the lighting apparatus, the driver circuit may control the motor to recover the positions of the first side light body and the second side light body.

In some embodiments, the lighting apparatus may also include a motor for rotating the first side light body and the second side light body when a switch receives a switch command.

The switch command may be a turn-on or a turn-off command. For example, the switch may be a wall switch connects to the lighting apparatus. When users turn on or turn off the wall switch, the wall switch sends the switch command to the light body.

The driver circuit in the light body detects the turn-on or turn-off commands and then automatically drives the motor to move the first side light body and the second side light body to change positions along a predetermined pattern.

For example, when the lighting apparatus is turn-on, the first side light body and the second side body are moved to expand an overall size of the lighting apparatus. Specifically, the first side light body on the left is moved further to left direction and the second side light body on the right is moved further to right direction to expand.

On the other hand, when users turn off the lighting apparatus, the driver circuit may control the motor to recover the positions of the first side light body and the second side light body.

In some embodiments, light body has an attachable cover attached to the light body, the attachable cover further includes multiple installation holes separated in equal distance for installing light bulbs.

In some embodiments, the multiple installation holes have a connecting basement connected to the light bulb and an installation basement connected to the attachable cover, the connecting basement and the installation basement each have an elastic portion to connect together, the connecting basement with the light bulb is detachable from the installation basement, the connecting basement has a stretching wire for hanging the light bulb, and for transmitting a power to the light bulb to emit light.

In some embodiments, the stretching wire has multiple positioning grooves for bending and to fastened a light emitting direction of the light bulb.

In some embodiments, the first side light body and the second side light body have at least an inner bucket structure for installing a standard light tube.

In some embodiments, the first side light body and the second side light body respectively have multiple separated pieces combined together, the multiple separated pieces are connected together by a plurality of elastic strings, the multiple separated pieces are dispersed out for a wider light emitting area.

In some embodiments, the multiple separated pieces have an edge space to connect each other, the edge space is overlapped with other edge space for connecting the multiple separated pieces, a total thickness of the edge space and the other edge space is same with the multiple separated pieces.

In some embodiments, the middle light body contains a standard light tube, the standard light tube is capable of being installed to a standard light tube bracket.

In some embodiments, the first side light body and the second side light body respectively contain a standard light tube.

In some embodiments, an edge of the light base connected to an attachable cover covering the center opening of the light body further includes two elastic buckle sheets, the elastic buckle sheets being moved out when the attachable cover are detached from the light base for connecting the main light body to the light base, the elastic buckle sheets are hidden in the light base when the attachable cover being connected to the light base.

In some embodiments, the first end box and the second end box further comprise a light rendering demonstrate device showing a light rendering level of an environment for controlling an intensity of exposure, the light rendering demonstrate device has a sensor to sense the intensity of exposure in the environment.

In some embodiments, the light rendering demonstrate device has a light receiving board for receiving an environment light and transmits the environment light into a lighting power, the lighting power provides an instruction light on the light rendering demonstrate device when the environment light is low.

In some embodiments, an attachable cover for covering the center opening of the light body further including at least a side bridge, the side bridge being foldable to close the attachable cover on a side of an edge of the light base connecting to the attachable cover when detaching the attachable cover.

In some embodiments, the top light is emitted on a surface for providing an indirect illuminance source.

DETAILED DESCRIPTION

Figure 1:
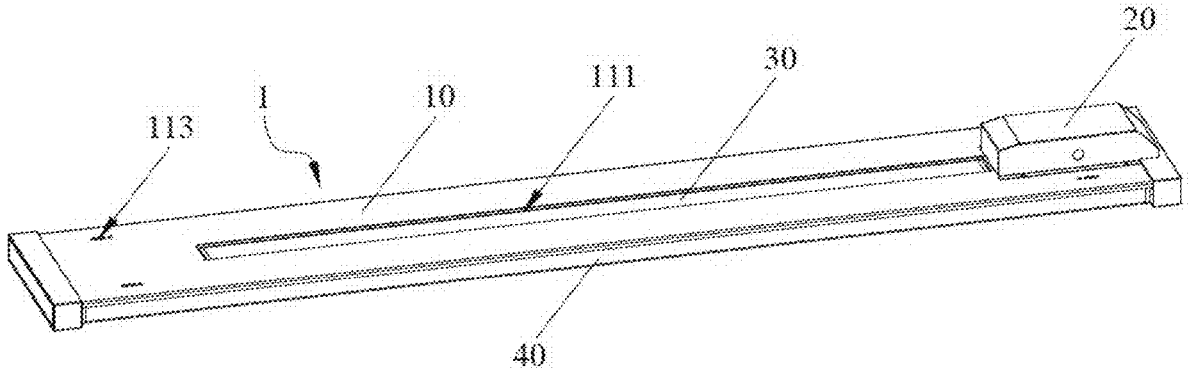
FIG. 1 illustrates an embodiment of a lighting apparatus.
Figure 2:
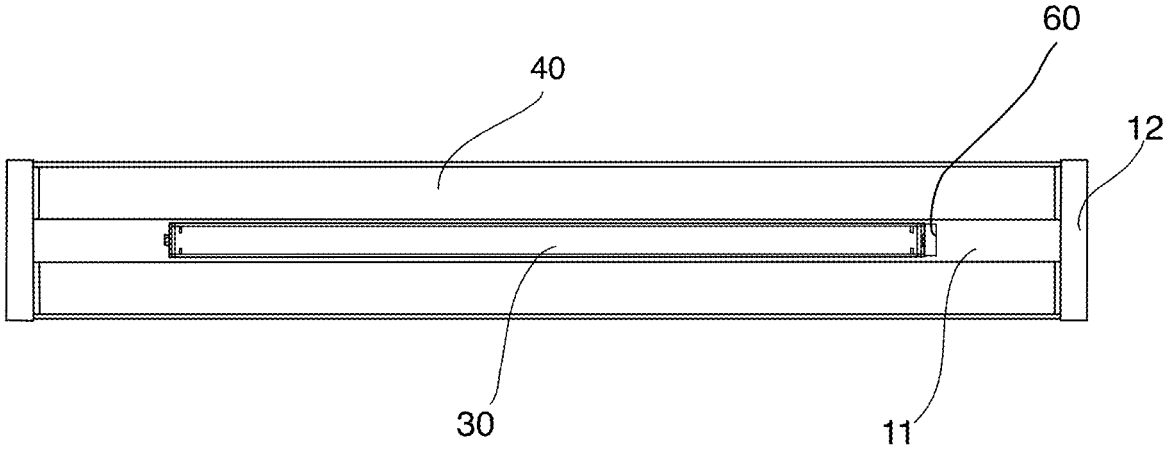
FIG. 2 illustrates a bottom view of an embodiment of the lighting apparatus.
Figure 3:
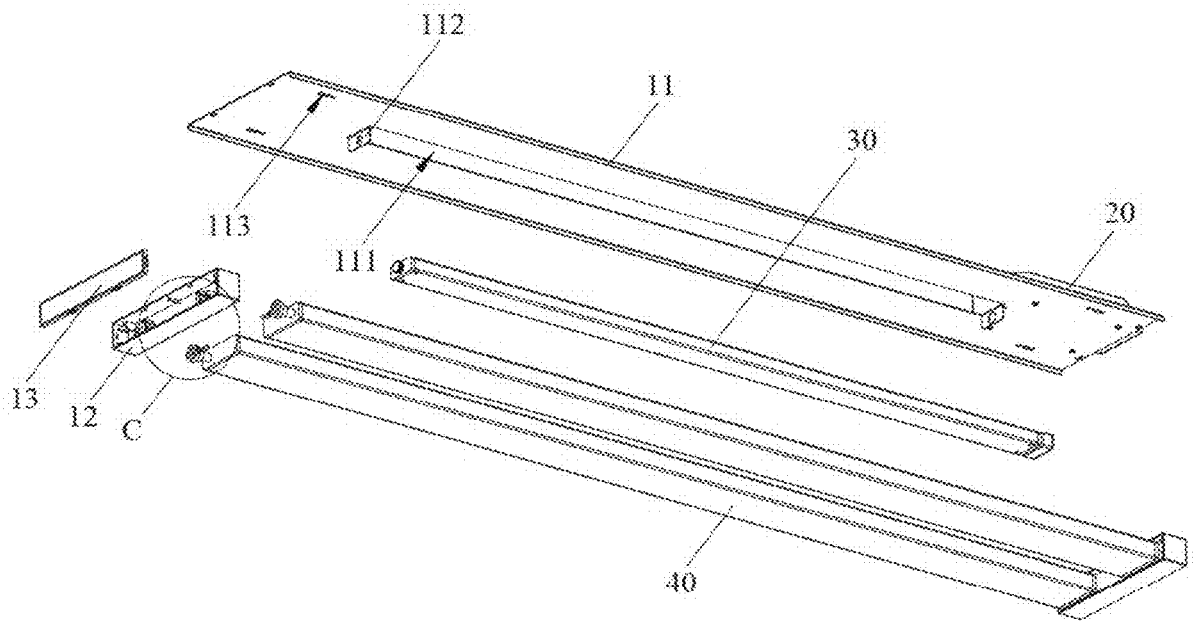
FIG. 3 illustrates an exploded view of an embodiment of the lighting apparatus.
Figure 4:
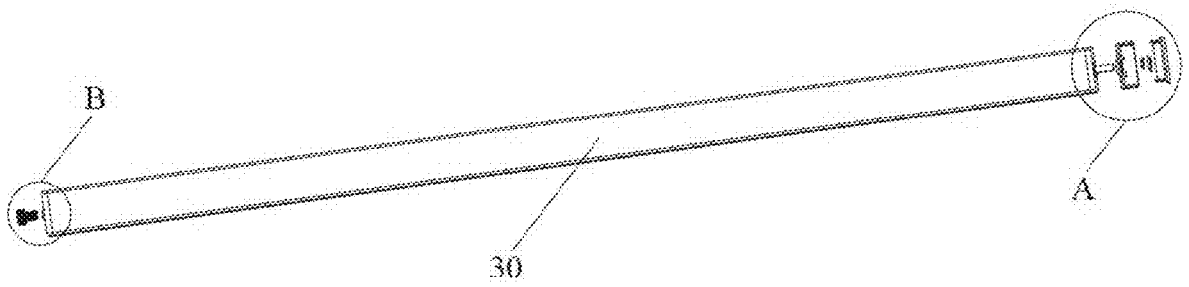
FIG. 4 illustrates an embodiment of the lighting apparatus.

Please refer to FIG. 1 to FIG. 3. A lighting apparatus 1 has a light base 10, a driving module 20, a first light body 30 and two second light body 40. The driving module 20 is set on the light base 10. The first light body 30 and the second light body 40 rotatably connect on the light base 10. The first light body 30 and the second light body 40 respectively electrically connect with the driving module 20. The driving module 20 connects with external power source to drive the first light body 30 and the second light body 40. The two second light body 40 are set on the corresponding two sides of the first light body 30. A light emitting angle of a light emitting surface of the first light body 30 and the second light body 40 is respectively equal to or bigger than 120. The rotation angle of the first light body 30 and the second light body 40 is 0°~180°. The driving module 20 is a common light driver in the field.

When the light emitting angle needs to be adjusted, an external power is added on the first light body 30 and the second light body 40 to drive the first light body 30 and the second light body 40 to rotate to the desired light emitting angle. To have 360° light emitting, adjust the first light body 30 to horizontal mode to let the light emitting surface of the first light body 30 faces up. Then adjust the light emitting surface of the second light body 40 to face down and drive the two second light body 40 to respectively rotate 60° toward the corresponding two sides of the first light body 30. Then make the angle between a light emitting axle of the two light emitting surfaces of the second light body 40 is 120°. Then make the angle between the two light emitting axles of the light emitting surfaces of the second light body 40 and the first light body 30 is 120°.

In an embodiment, the first light body 30 and the second light body 40 are capable of rotatably setting on the light base 10. The rotation of the first light body 30 and/or the second light body 40 enables the adjustment of the light emitting angle. The rotation of the first light body 30 and the two second light body 40 makes the angle of the light emitting axles of the light emitting surface of the first light body 30 and the two light body 40 is 120°, and further to enable 360° light emitting.

Please refer to FIG. 2, FIG. 3, FIG. 5, FIG. 7, FIG. 10 and FIG. 11. The light base 10 has a back cover 11 and two end box 12. The two end box 12 fasten to the two corresponding ends of the back cover 11. The first light body 30 rotatably connects with the back cover 11. An avoidance hole 111 is set on the back cover 11. The avoidance hole 111 is used for avoiding the gap between the first light body 30, the second light body 40 and the back cover 11 to ensure the second light body 40 has enough rotation space. The first light body 30 and the second light body 40 are set on the same side of the back cover 11. Two ends of the second light body 40 respectively rotatably connect with two end box 12. More particularly, an outline size of the avoidance hole 111 matches with the outline size of the first light body 30. When the first light body 30 rotates 180°, the light emitted from the light emitting surface of the first light body 30 is capable of passing through the avoidance hole 111, illuminating the ceiling, and being reflected by the ceiling to the room, and enlarging the illuminating range of the lighting apparatus. A pair of a flange 112 is convexly set on the back cover 11. The pair of the flange 112 extends down from the corresponding two edges of the two ends of the avoidance hole 111. A first protrusion 31 is convexly set on a first end of the first light body 30. A second protrusion 32 is convexly set on a second end of the first light body 30. The first protrusion 31 and the second protrusion 32 respectively pass through and rotatably connect with the two flange 112. Therefore, only the external power is needed on the first light body 30 to drive the first light body 30 to rotate to desired light emitting angle. A first connecting axle 41 is convexly set on the first end of the second light body 40. A second connecting axle 42 is convexly set on the second end of the second light body 40. The first connecting axle 41 and the second connecting axle 42 respectively pass through and rotatably connect with the two end box 12. Therefore, only the external power is needed on the second light body 40 to drive the second light body 40 to rotate to desired light emitting angle.

Please refer to FIG. 2, FIG. 3, FIG. 5 and FIG. 8. The lighting apparatus 1 has a first limiting structure 60 and a second limiting structure 70. The first limiting structure 60 is set on the back cover 11 and connects with the first end of the first light body 30 to fix the first light body 30 at the desired light emitting angle. The second limiting structure 70 is set in the end box 12 and connects with the first end of the second light body 40 to fix the second light body 40 at the desired light emitting angle. More particularly, the first limiting structure 60 is set on the side of the flange 12. The first protrusion 31 of the first light body 30 passes through the flange 112 to connect with the first limiting structure 60.

The second limiting structure 70 is set in the end box 12, and a side of the end box 12 is sealed by an end cover 13. The end cover 13 is capable of being opened during the installation or maintenance of the second limiting structure 70. One end of the first connecting axle 41 of the second light body 40 passes through a side of the end box 12 and extends into an inner part of the end box 12 to connect with the second limiting structure 70. Therefore, the first light body 30 and the second light body 40 are easy to be set at the desired light emitting angle, and the unstable illuminating effect caused by the random rotation of the first light body 30 and the second light body 40 is prevented.

Please refer to FIG. 4 to FIG. 7. A rotating axle 50 is convexly set on the first end of the first light body 30. The first limiting structure 60 has a housing 61, a facing ring 62 and a limiting sheet 63. The housing 61 is fixed on the back cover 11. The rotating axle 50 extends into the housing 61. The facing ring 62 is set in the housing 61 and on the rotating axle 50. The limiting sheet 63 is set in the housing 61 and on the rotating axle 50 to press the facing ring 62 engaging on the inner wall of the housing 61. More particularly, one end of the rotating axle 50 connects with the first protrusion 31 of the first light body 30. The other end of the rotating axle 50 passes through the side wall of the housing 61 and extends into the inner part of the housing 61. The facing ring 62 and the limiting sheet 63 set on the rotating axle 50 in order. The limiting sheet 63 and the rotating axle overly match to press the facing ring 62 to the inner wall of the housing 61. The facing ring 62 is capable of being a metal facing ring, a rubber facing ring or a glass fiber coil. The increase of a coefficient of friction of a connecting surface of the facing ring 62 enables a damping effect during the rotation of the first light body 30, and further enables the first light body 30 fixes at the desired light emitting angle. The second end of the first light body 30 passes through the flange 12 through a screw 80 and rotates in the second protrusion 32 to connect with the back cover 11. Therefore, the fall of the second end of the first light body 30 from the flange 112 is prevented. And the first light body 30 is capable of being installed on the back cover 11 without tools to simplify the installation and disassembly of the first light body 30. The first limiting structure 60 has a housing cover 64. One side of the housing 61 is sealed by the housing cover 64. The housing cover 64 is capable of being opened during the installation or maintenance of the facing ring 62 and the limiting sheet 63.

Figure 5:
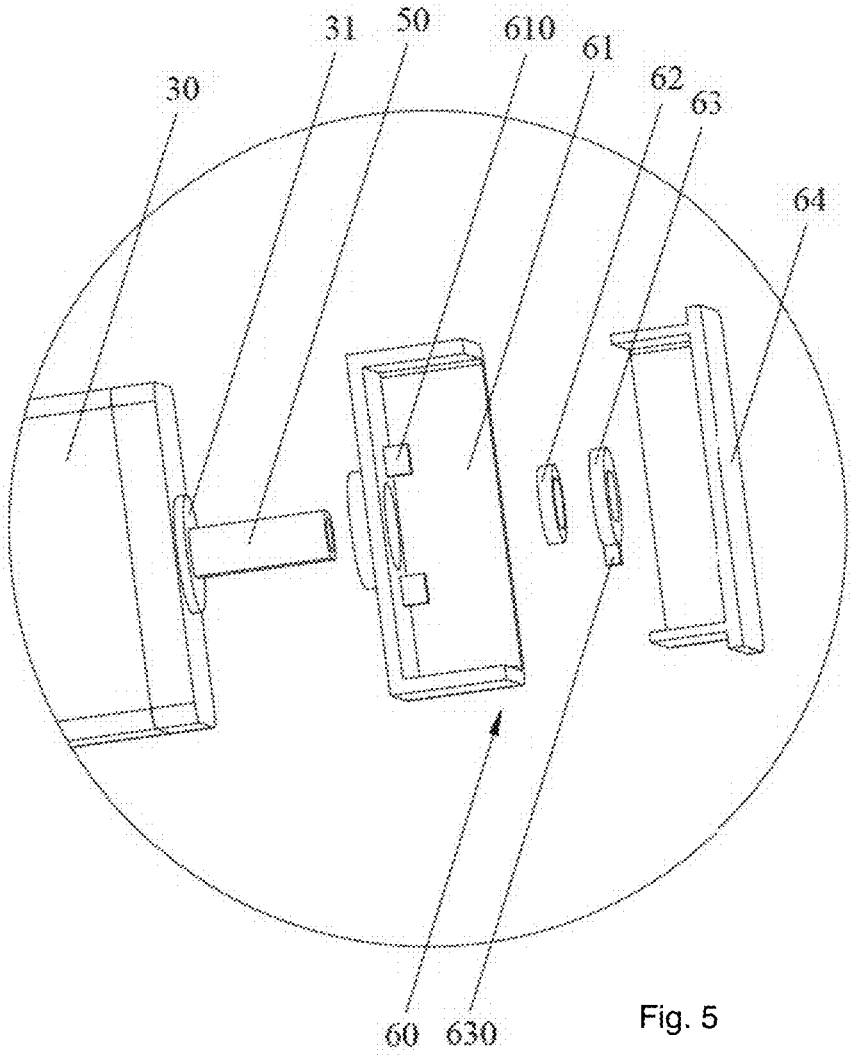
FIG. 5 illustrates a partial view of an embodiment of the lighting apparatus.
Figure 6:
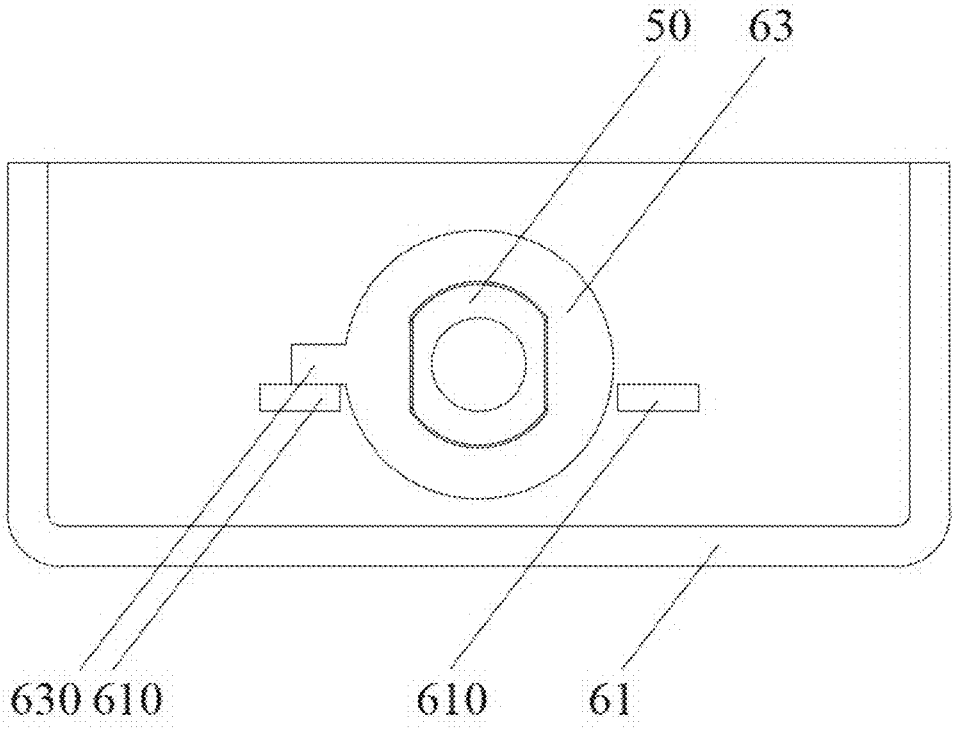
FIG. 6 illustrates a partial view of an embodiment of the lighting apparatus.
Figure 7:
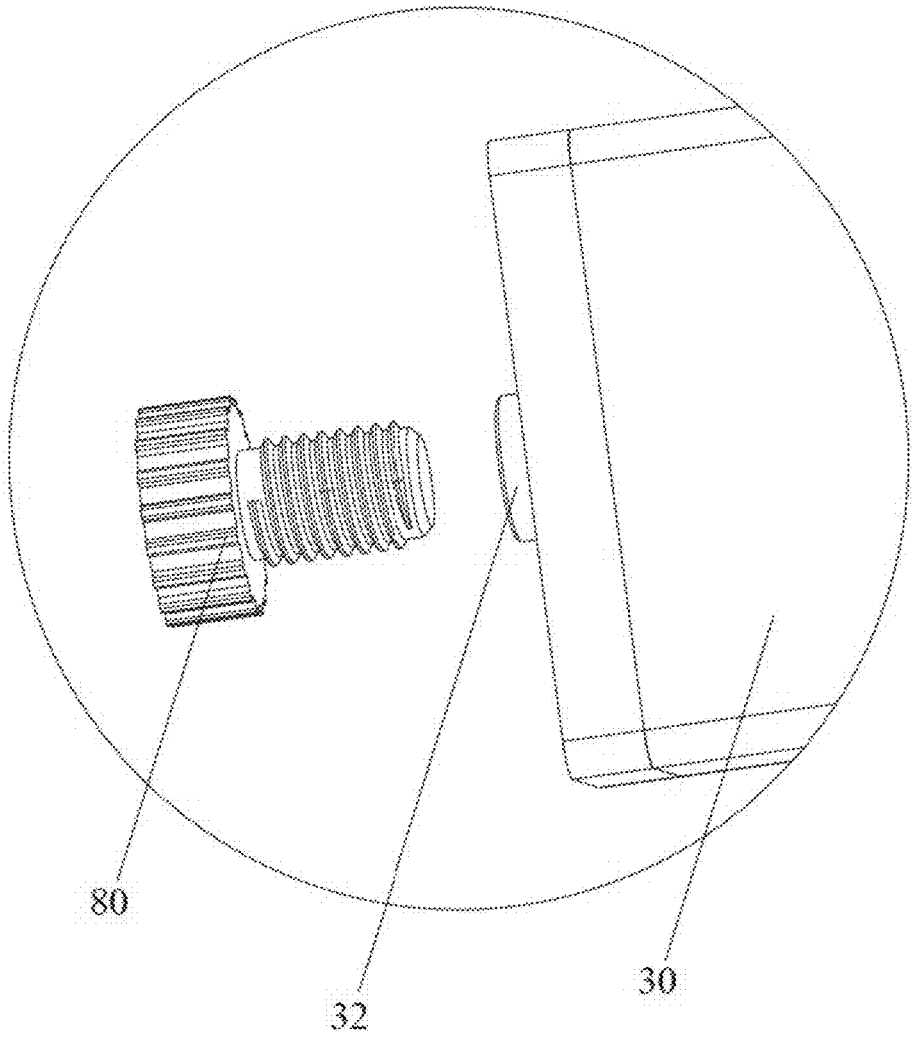
FIG. 7 illustrates a partial view of an embodiment of the lighting apparatus.

Please refer to FIG. 5 and FIG. 6 for an embodiment of the lighting apparatus. Two limiting protrusion 610 are convexly set on the inner wall of the housing 61. The two limiting protrusion 610 set correspondingly on the corresponding two sides of the rotating axle 50. The limiting protrusion 610 is capable of pressing the protrusion part of the limiting sheet 63 to limit the rotation angle of the first light body 30. More particularly, an installation hole is set on the inner wall of the housing 61. The installation hole matches with the rotating axle 50. Two limiting protrusion 610 are set correspondingly on the corresponding two sides of the installation hole. When the lighting apparatus is installed horizontally, the limiting protrusion 610 is set horizontally. The protrusion part 630 of the limiting sheet 63 is capable of pressing the top face of the limiting protrusion 610 to ensure the first light body 30 rotates around the rotating axle 50 between 0'~180° and to increase the stability of the first light body 30 at the angle of 0° and 180°.

Please refer to FIG. 8 to FIG. 11. The second limiting structure 70 has a gear 71 and a pausing module 72. The gear 71 is set on the first connecting axle 41 of the second light body 40. The pausing module 72 and the gear 71 elastically connect to limit the rotation of the first connecting axle 41. More particularly, the gear 71 and the pausing module 72 are set near the end box 12 of the first end of the second light body 40. The gear 71 fastens on the end of the first connecting axle 41 extending into the end box 12. The gear 71 has the same axle with the first connecting axle 41. At least a concave groove 410 is set on the first connecting axle 41. The concave groove 410 extends along the axial direction of the first connection axle 41 and sets along the ring of the connecting axle 41. At lease a positioning protrusion 710 is convexly set on an inner hole of the gear 71. The positioning protrusion 710 and the concave groove respectively corresponds. The positioning protrusion 710 extends into the concave groove 410 to ensure the gear 71 and the first connecting axle 41 rotate simultaneously. One end of the pausing module 72 is capable of extending into the root of the gear 71 or retracting from the root of the gear 71. When one end of the pausing module 72 extends into the root of the gear 71, the pausing module 72 is capable of limiting the rotation of the gear 71 to position the second light body 40 at the desired light emitting angle, and to further prevent the second light body 40 from randomly rotating.

Figure 10:
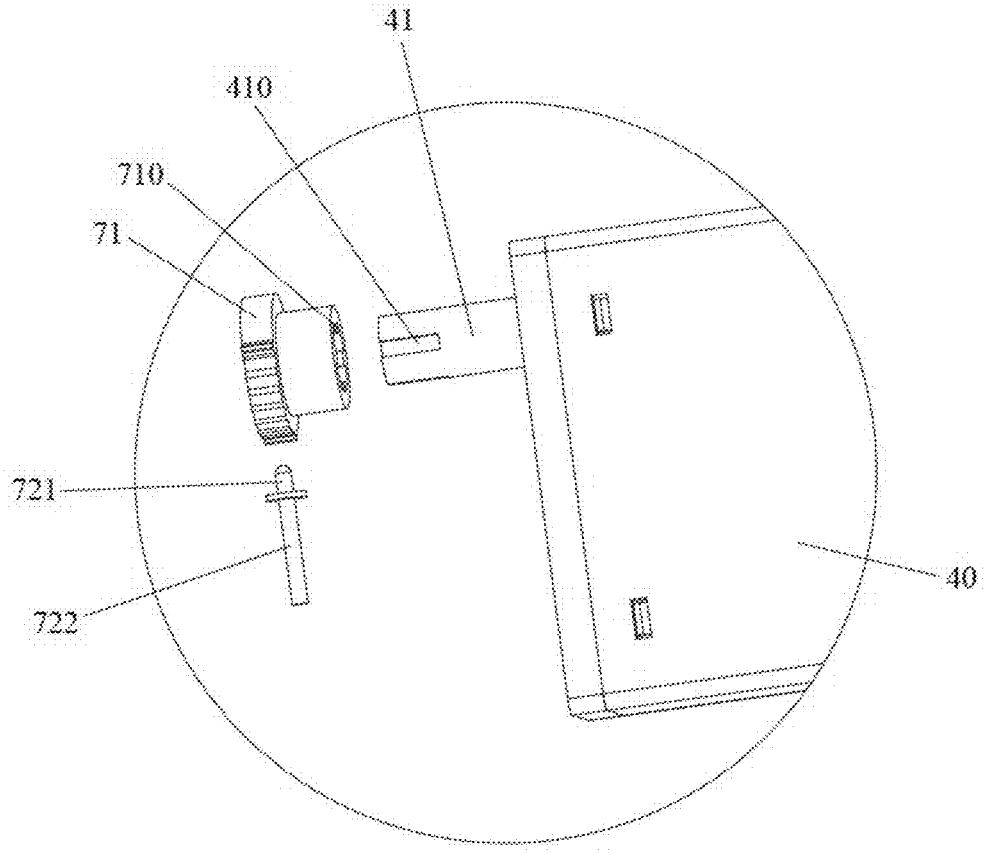
FIG. 10 illustrates a partial view of an embodiment of the lighting apparatus.
Figure 11:
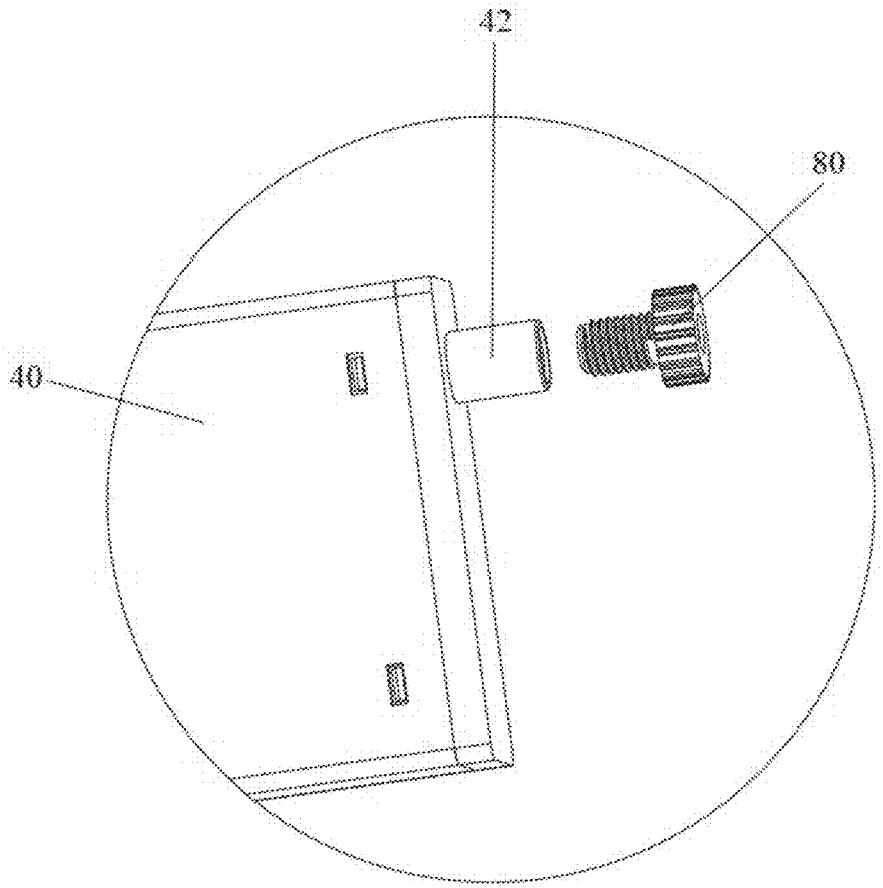
FIG. 11 illustrates a partial view of an embodiment of the lighting apparatus.

Please refer to FIG. 10 and FIG. 11. The first connecting axle 41 is fixed on the end of a first end face of the second light body 40 being away from the first light body 30. That means, the first connecting axle 41 of the second light body 40 locating on the left side of the first light body 30 is fixed on the left side of the first end face. The first connecting axle 41 of the second light body 40 locating on the right side of the first light body 30 is fixed on the right side of the first end face. The second connecting axle 42 of the second light body 40 locating on the left side of the first light body 30 is fixed on the left side of the second end face. The second connecting axle 42 of the second light body 40 locating on the right side of the first light body 30 is fixed on the right side of the first end face. Therefore, the space needed for the second light body 40 when rotating along the first connecting axle 41 and the second connecting axle 42 is at minimum. The distance between the second light body 40 and the back cover 11 is reduced to simplify the whole structure of the lighting apparatus. The protrusion of the gear 71 is set in the one fourth area of the outer edge to limit the rotation angle of the second light body 40 between 0° ~90°, and to further ensure the stability of the light emitting angle of the second light body 40.

Figure 8:
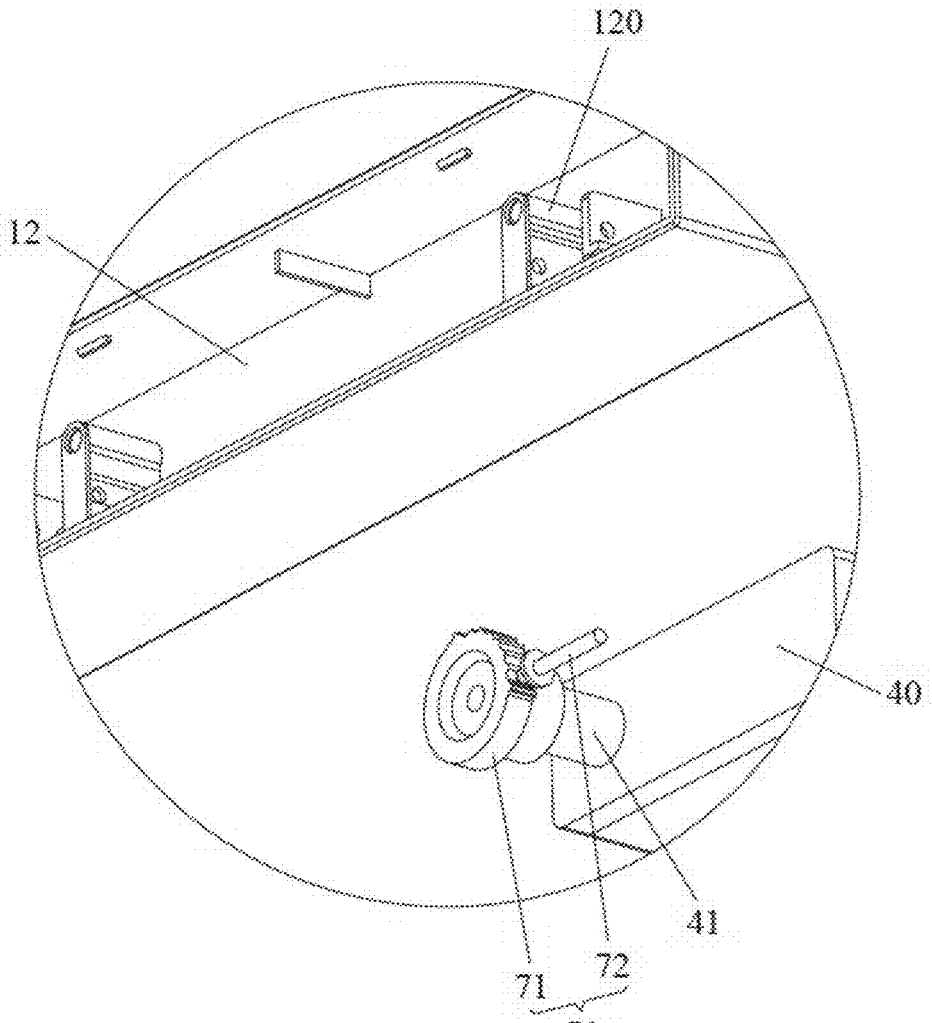
FIG. 8 illustrates a partial view of an embodiment of the lighting apparatus.
Figure 9:
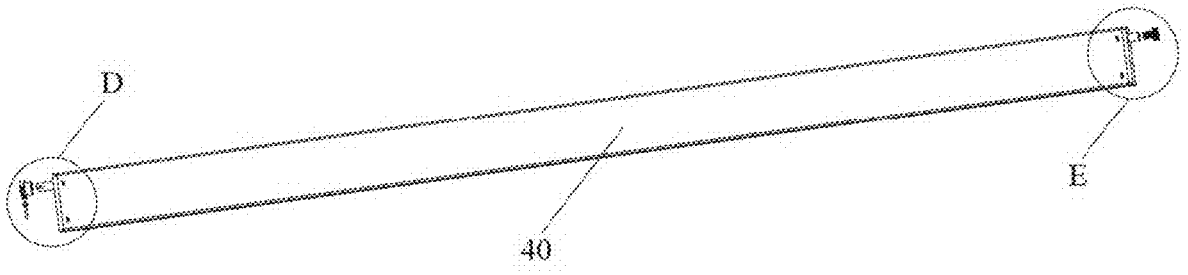
FIG. 9 illustrates a side view of an embodiment of the lighting apparatus.

Please refer to FIG. 8 and FIG. 10. The pausing module 72 has a supporting column 721 and an elastic module. One end of the supporting column 721 meshed with the gear 71. One end of the elastic module meets with the other end of the supporting column 721. The other end of the elastic module meets with a connecting portion 120 of the end box 12. More particularly, the elastic module is ideally a compression spring. The supporting column 721 presses on the outer edge of the gear 71 under the elastic force of the elastic module. The supporting column 721 is capable of flexibly moving along the root and the protrusion of the gear 71. When the supporting column 721 extends into the root of the gear 71, the supporting column 721 is capable of limiting the rotation of the gear 71 and enables the second light body 40 to be positioned at desired light emitting angle, and further prevent the random rotation of the second light body 40.

Please refer to FIG. 10. The pausing module 72 has a sleeve tube 772. One end of the sleeve tube 722 fastens to the connecting portion 120 of the end box 12. One end of the supporting column 721 extends into the sleeve tube 721 from the other end of the sleeve tube 722. The elastic module is set in the sleeve tube 722. More particularly, the connecting portion 120 is convexly set on the inner wall of the end box 12. The connecting portion 120 is aside of the gear 71. One end of the sleeve tube 722 fastens on the connecting portion 120. The other end of the sleeve tube 722 faces to the gear 71. One end of the supporting column 721 extends into the sleeve tube 722 and connects with the sleeve tube 722. The elastic module is clipped between the supporting column 721 and the top end of the sleeve tube 722 fastening on the connecting portion 120. The supporting column 721 is capable of flexibly moving along the gear 71 under the elastic force of the elastic module. Therefore, the sleeve tube 722 has the guiding function to ensure the stability of the supporting column 721 and to further prevent the supporting column 721 falls from the gear 71.

Please refer to FIG. 1 and FIG. 3. At least three installation hanging unit 113 is set on the back cover 11. The installation hanging unit 113 is spaced disposed. More particularly, the neighboring two installation hanging unit 113 are spaced disposed. The neighboring two installation hanging unit 113 are not in the same line to ensure the stability of the lighting apparatus. Every installation hanging unit 113 has an oblong hole and a circular hole. The length of the oblong hole is equal to or longer than the width of a hanger to let the hanger to pass through easily. The open end of the hanger extends into the circular hole to let the hanger to connect to the space between the oblong hole and the circular hole, and to further complete the installation of the lighting apparatus.

Figure 12:
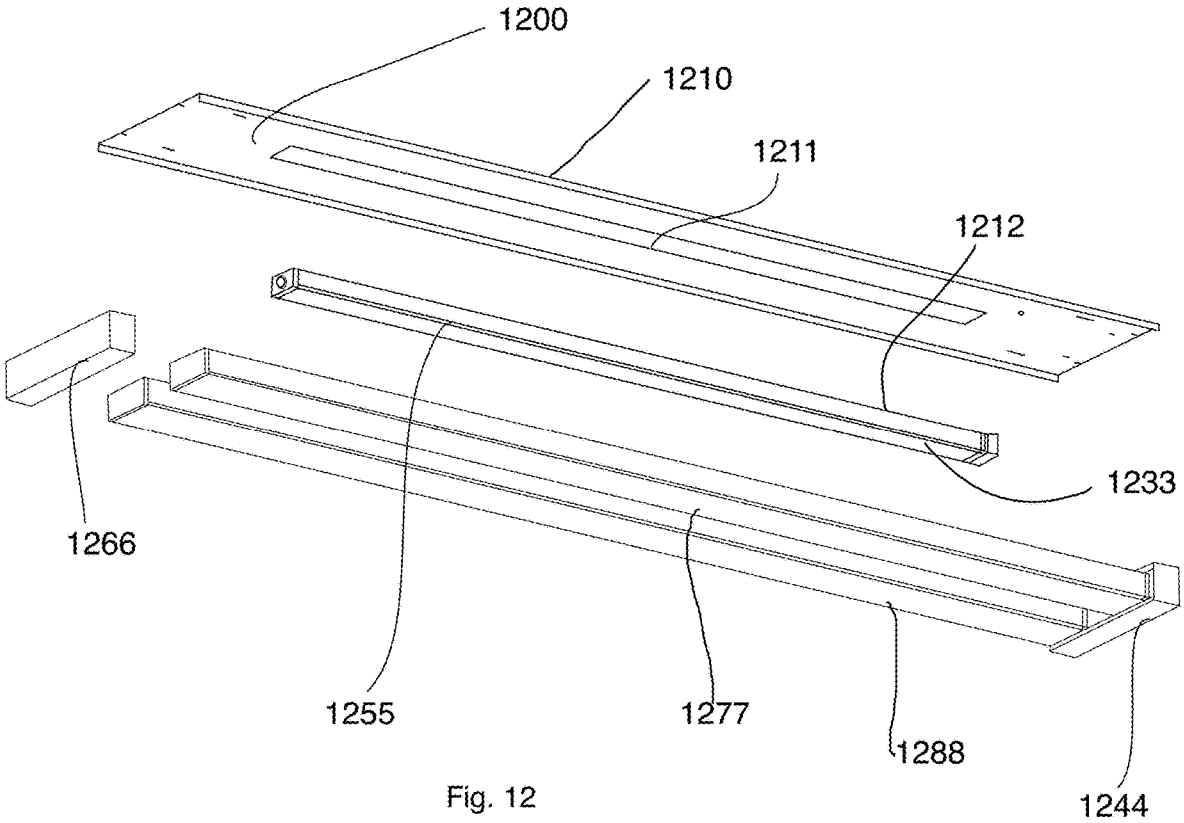
FIG. 12 illustrates an exploded view of an embodiment of the lighting apparatus.

Please refer FIG. 12. A lighting apparatus includes a light base 1200, a middle light body 1255, a first end box 1266, a second end box 1244, a first side light body 1277, a second side light body 1288.

The light base 1200 has a main body 1210 and a center opening 1211 located in a middle place of the main body 1210. For example, the light base 1200 has a bracket housing. The bracket housing has a rectangular shape with a center opening 1211.

The middle light body 1255 is connected to the light base 1200 for emitting a top light 1212 passing through the center opening 1211 of the light base 1200 and for emitting a bottom light 1233 in a direction opposite to the top light 1212. For example, the light body is installed close to a ceiling but left with a space. The center opening 1211 allows light from the middle body 1255 to emit light passing through the center opening 1211 and projecting the light on the space forming an indirect luminance light source.

The first end box 1266 and the second end box 1244 are attached to two opposite ends of the light body. The first side light body 1277 is connected to the first end box 1266 and the second end box 1244 for emitting a first lateral light. The second side light body 1288 is connected to the first end box 1266 and the second end box 1244 for emitting a second lateral light. The first side light body 1277 and the second light body 1288 are located on two opposite sides of the middle light body 1255.

The first side light body 1277 and the second side light body 1288 are rotatable with respect to the first end box 1266 and the second end box 1244 for adjusting light emitting angles of the first lateral light and the second lateral light.

In some embodiments, the middle light body is a light tube with a top surface for passing the top light 1212 and with a bottom surface for passing the bottom light 1233.

There are multiple LED modules disposed on an elongated substrate in the light tube for emitting the top light and the bottom light.

In some embodiments, there are two sets of LED modules disposed on opposite sides of the elongated substrate. One set emits the top light and the other set emits the bottom light.

In some embodiments, the first side light body and the second side light body are light tubes with LED modules.

In some embodiments, the first side light body and the second side light body respectively have main light directions, e.g. 120 degrees wide major light output angle.

By rotating the first side light body and/or the second side light body for changing light directions of the first lateral light and the second lateral light ensures more complete or specific areas are illuminated.

Figure 13:
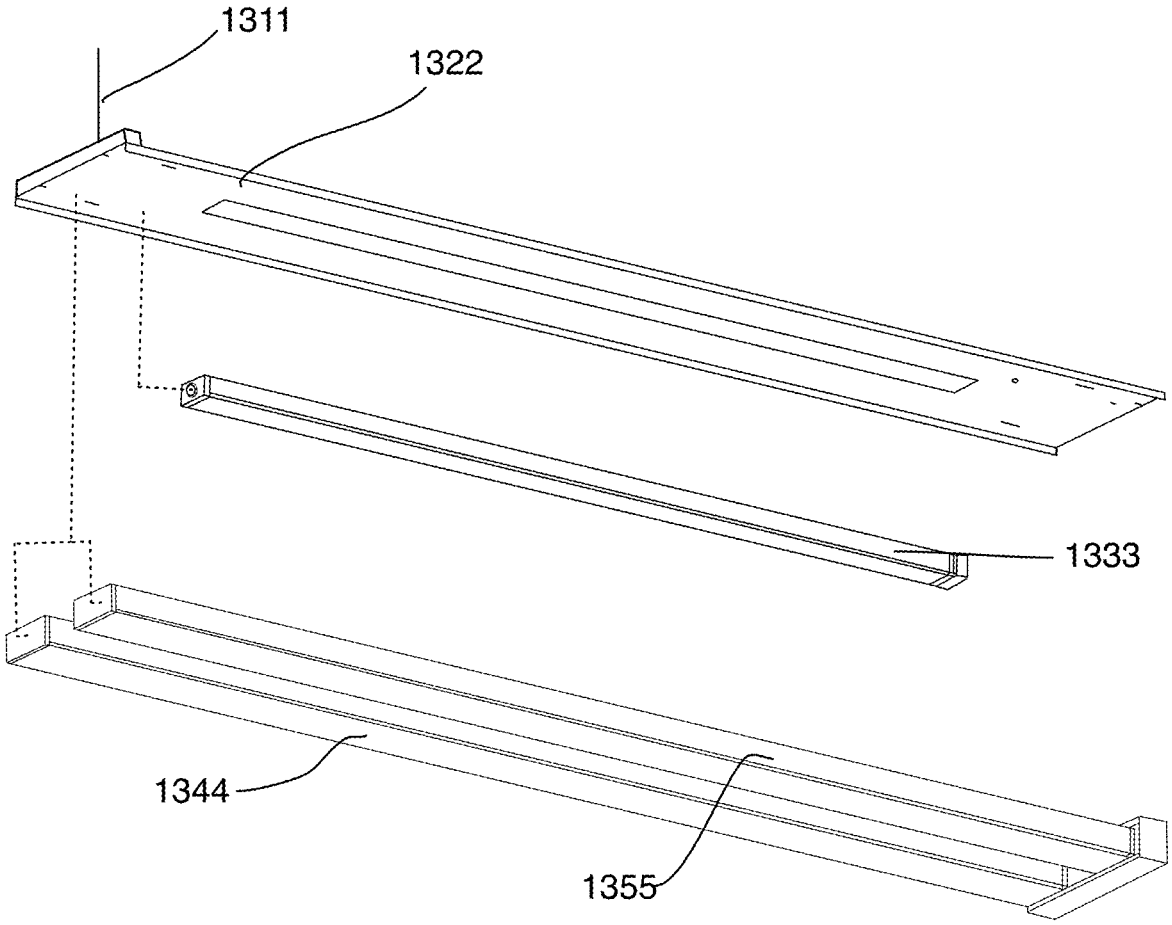
FIG. 13 illustrates an exploded view of an embodiment of the lighting apparatus.

Please refer to FIG. 13. The light base 1322 has a conductive path 1311 for routing electricity from an external power source to the middle light body 1333. The first side light body 1344 and the second side light body 1355.

In some embodiments, a driver circuit is also integrated in the light base. Specifically, an indoor power like a 110V or 220V alternating current is connected to the driver circuit. The driver circuit converts the indoor power to proper direct currents and supplies the direct currents to the middle light body, the first side light body and the second side light body.

Figure 14:
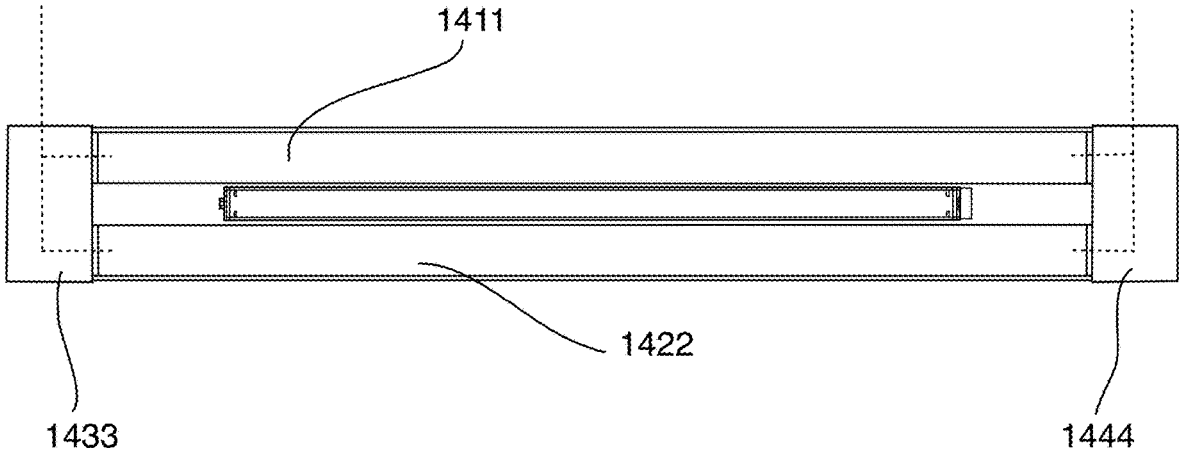
FIG. 14 illustrates a bottom view of an embodiment of the lighting apparatus.

Please refer to FIG. 14. The first end box 1433 and the second end box 1444 receives electricity from the conductive path of the light base and supply the electricity to the first side light body 1411 and the second side light body 1422.

The electricity connection between the first end box and the second end box to the light body is a wireless power transmission.

Figure 15:
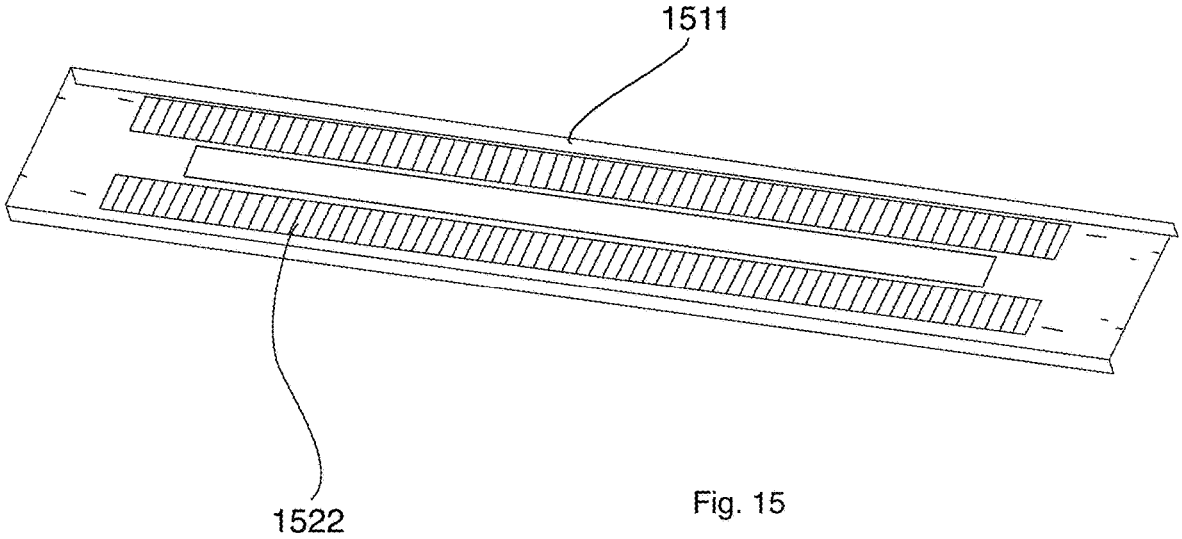
FIG. 15 illustrates a bottom view of an embodiment of the lighting apparatus.

Please refer to FIG. 15. The lighting apparatus may also include a plurality of LED light sources 1522 disposed at a bottom of the light base 1511.

Figure 16:
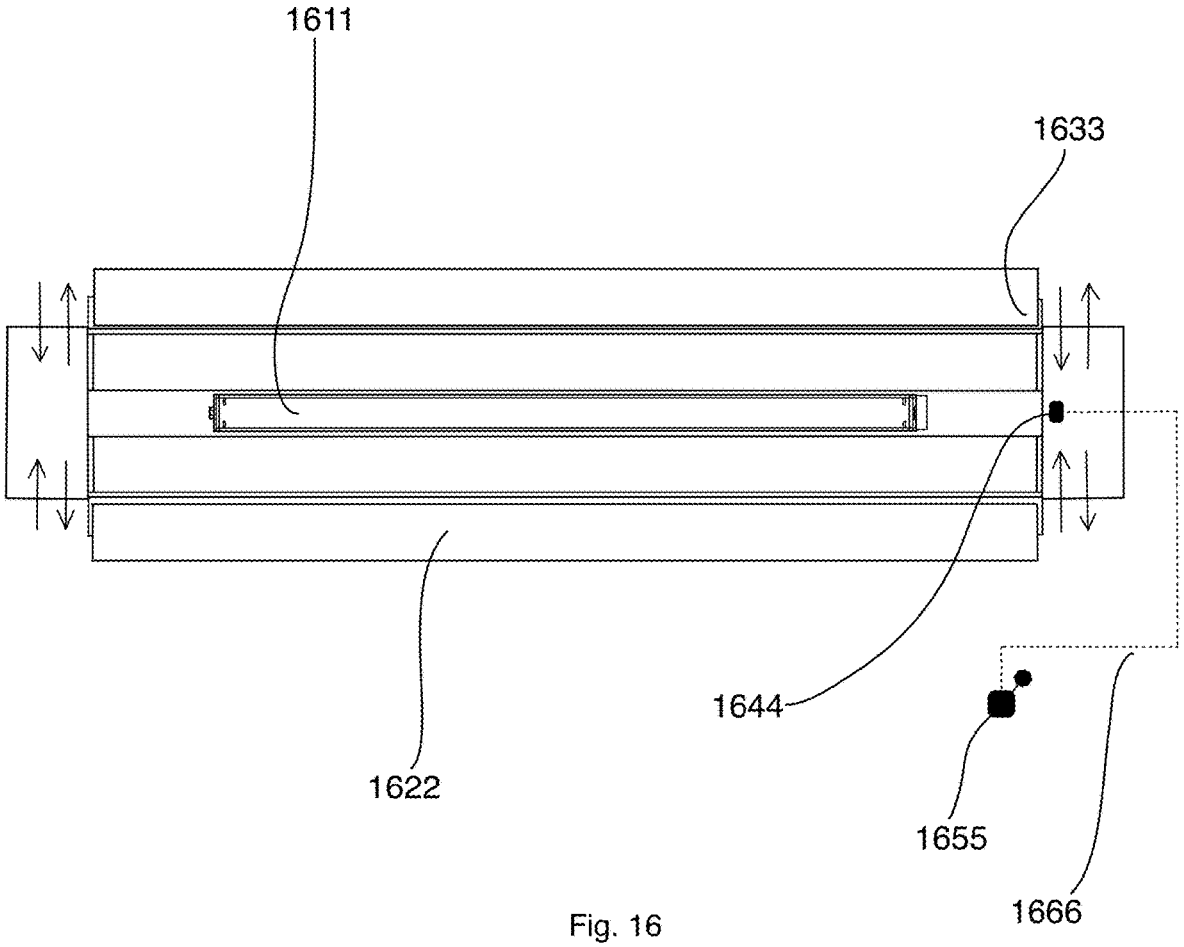
FIG. 16 illustrates a bottom view of an embodiment of the lighting apparatus.

Please refer to FIG. 16. In addition to rotate with respect to the first end box and the second end box, the first side light body 1622 and the second light body 1633 are operable to be moved closer or farther to the middle light body 1611.

For example, there are shifting structures in the first end box and the second end box for moving the first side light body and the second side light body horizontally.

In some embodiments, the lighting apparatus may also include a motor 1644 for moving the first side light body 1622 and the second side light body 1633 when a switch 1655 receives a switch command 1666.

The switch command 1666 may be a turn-on or a turn-off command. For example, the switch 1655 may be a wall switch connects to the lighting apparatus. When users turn on or turn off the wall switch, the wall switch sends the switch command to the light body.

The driver circuit in the light body detects the turn-on or turn-off commands and then automatically drives the motor to move the first side light body and the second side light body to change positions along a predetermined pattern.

For example, when the lighting apparatus is turn-on, the first side light body and the second side body are moved to expand an overall size of the lighting apparatus. Specifically, the first side light body on the left is moved further to left direction and the second side light body on the right is moved further to right direction to expand.

On the other hand, when users turn off the lighting apparatus, the driver circuit may control the motor to recover the positions of the first side light body and the second side light body.

Figure 17:
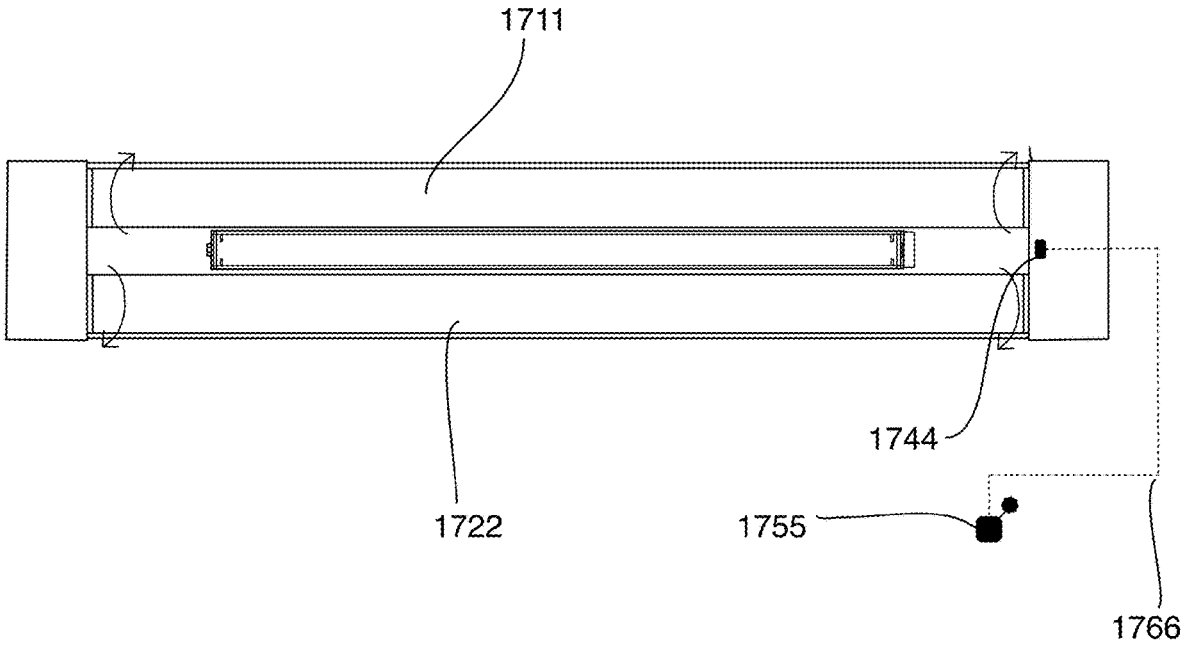
FIG. 17 illustrates a bottom view of an embodiment of the lighting apparatus.

Please refer to FIG. 17. The lighting apparatus may also include a motor 1744 for rotating the first side light body 1711 and the second side light body 1722 when a switch 1755 receives a switch command 1766.

The switch command may be a turn-on or a turn-off command. For example, the switch may be a wall switch connects to the lighting apparatus. When users turn on or turn off the wall switch, the wall switch sends the switch command to the light body.

The driver circuit in the light body detects the turn-on or turn-off commands and then automatically drives the motor to move the first side light body and the second side light body to change positions along a predetermined pattern.

For example, when the lighting apparatus is turn-on, the first side light body and the second side body are moved to expand an overall size of the lighting apparatus. Specifically, the first side light body on the left is moved further to left direction and the second side light body on the right is moved further to right direction to expand.

On the other hand, when users turn off the lighting apparatus, the driver circuit may control the motor to recover the positions of the first side light body and the second side light body.

Figure 18:
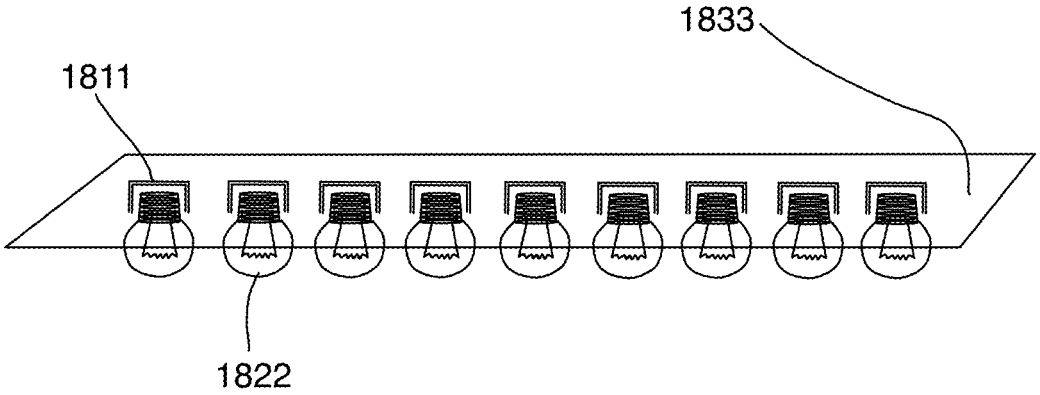
FIG. 18 illustrates a schematic side view of an embodiment of the lighting apparatus.

Please refer to FIG. 18. The light body has an attachable cover 1833 attached to the light body, the attachable cover 1833 further includes multiple installation holes 1811 separated in equal distance for installing light bulbs 1822.

Figure 19:
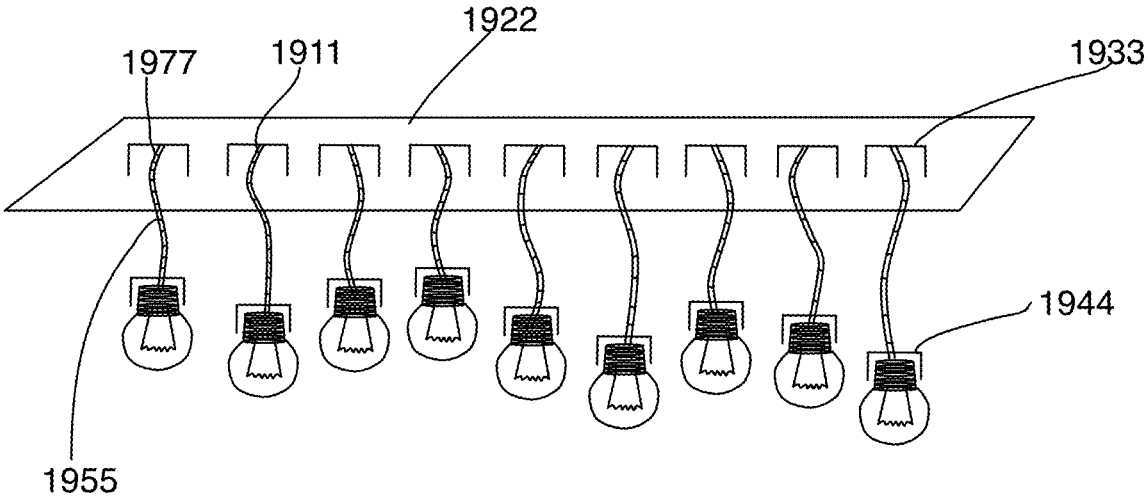
FIG. 19 illustrates a schematic side view of an embodiment of the lighting apparatus.

Please refer to FIG. 19. The multiple installation holes have a connecting basement 1944 connected to the light bulb and an installation basement 1933 connected to the attachable cover 1922. The connecting basement 1944 and the installation basement 1933 each have an elastic portion 1911 to connect together. The connecting basement 1944 with the light bulb is detachable from the installation basement 1933. The connecting basement 1944 has a stretching wire 1955 for hanging the light bulb, and for transmitting a power to the light bulb to emit light.

In some embodiments, the stretching wire 1955 has multiple positioning grooves 1977 for bending and to fasten a light emitting direction of the light bulb.

Figure 20:
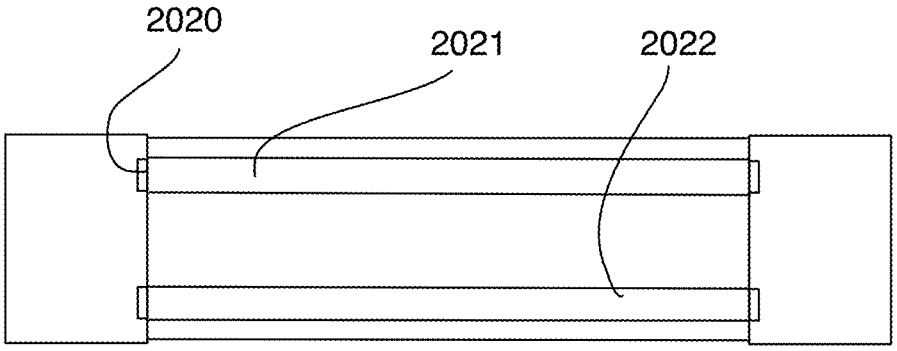
FIG. 20 illustrates a bottom view of an embodiment of the lighting apparatus.

Please refer to FIG. 20. The first side light body 2021 and the second side light body 2022 have at least an inner bucket structure 2020 for installing a standard light tube.

Figure 21:
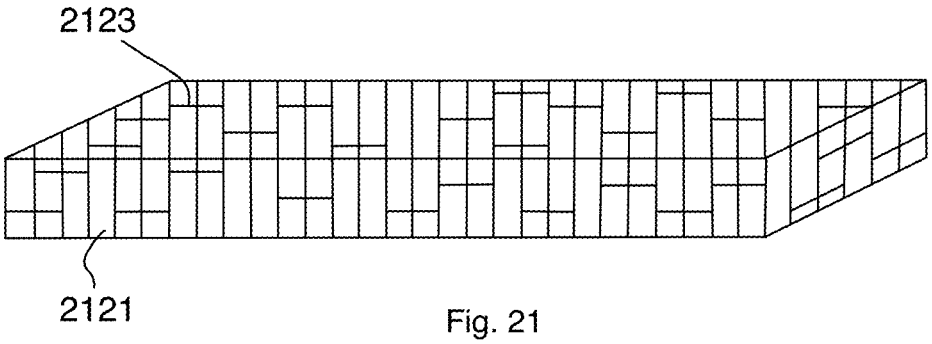
FIG. 21 illustrates a schematic side view of an embodiment of the lighting apparatus.

Please refer to FIG. 21. The first side light body and the second side light body respectively have multiple separated pieces 2121 combined together. The multiple separated pieces 2121 are connected together by a plurality of elastic strings 2123. The multiple separated pieces 2121 are dispersed out for a wider light emitting area.

Figure 22:
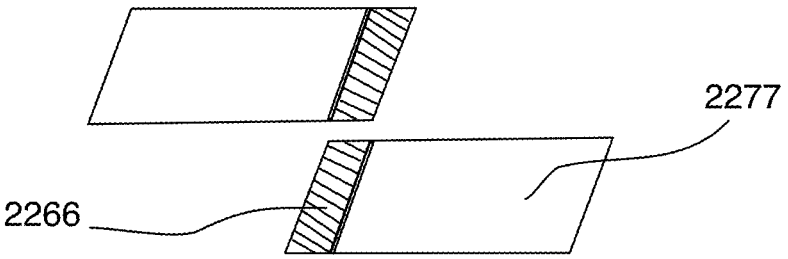
FIG. 22 illustrates a partial view of FIG. 21.

Please refer to FIG. 22. The multiple separated pieces 2277 have an edge space 2266 to connect each other. The edge space 2266 is overlapped with other edge space for connecting the multiple separated pieces 2277. A total thickness of the edge space 2266 and the other edge space is same with the multiple separated pieces 2277.

In some embodiments, the middle light body contains a standard light tube, the standard light tube is capable of being installed to a standard light tube bracket.

In some embodiments, the first side light body and the second side light body respectively contain a standard light tube.

Figure 23:
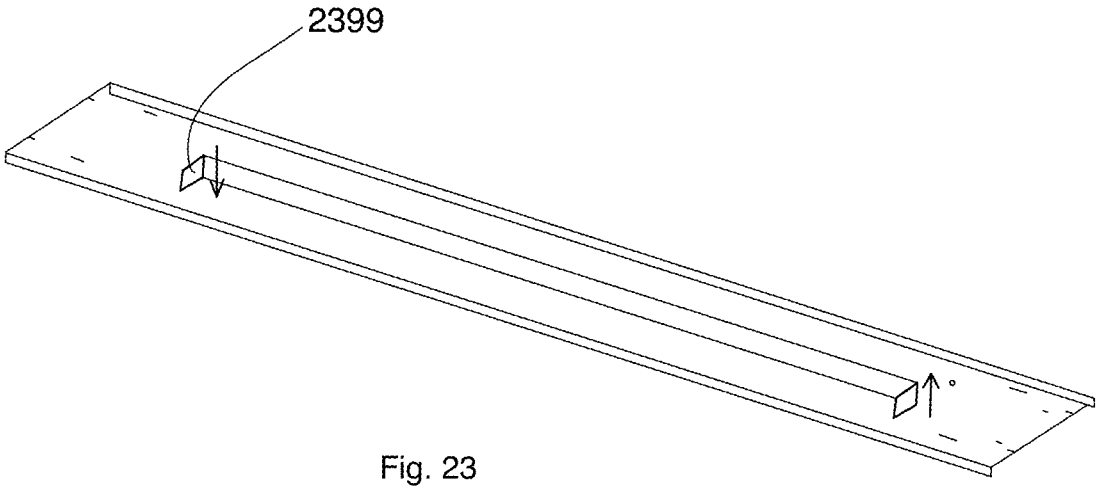
FIG. 23 illustrates a bottom view of an embodiment of the lighting apparatus.

Please refer to FIG. 23. An edge of the light base connected to an attachable cover covering the center opening of the light body further includes two elastic buckle sheets 2399, the elastic buckle sheets 2399 being moved out when the attachable cover are detached from the light base for connecting the main light body to the light base, the elastic buckle sheets 2399 are hidden in the light base when the attachable cover being connected to the light base.

Figure 24:
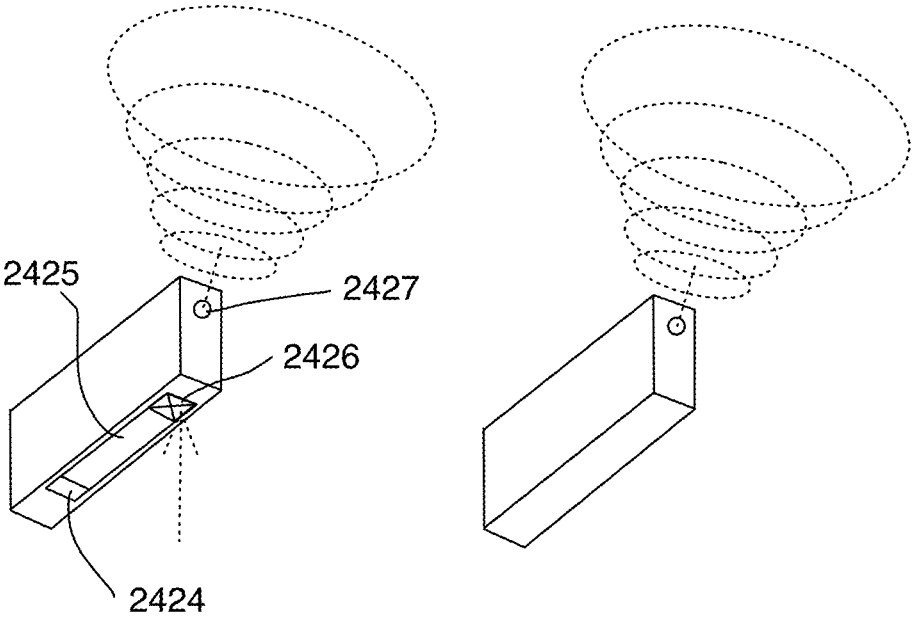
FIG. 24 illustrates an embodiment of a light rendering demonstrate device.

Please refer to FIG. 24. The first end box and the second end box further comprise a light rendering demonstrate device 2425 showing a light rendering level of an environment for controlling an intensity of exposure, the light rendering demonstrate device has a sensor 2427 to sense the intensity of exposure in the environment.

In some embodiments, the light rendering demonstrate device 2425 has a light receiving board 2426 for receiving an environment light and transmits the environment light into a lighting power. The lighting power provides an instruction light 2424 on the light rendering demonstrate device 2425 when the environment light is low.

Figure 25:
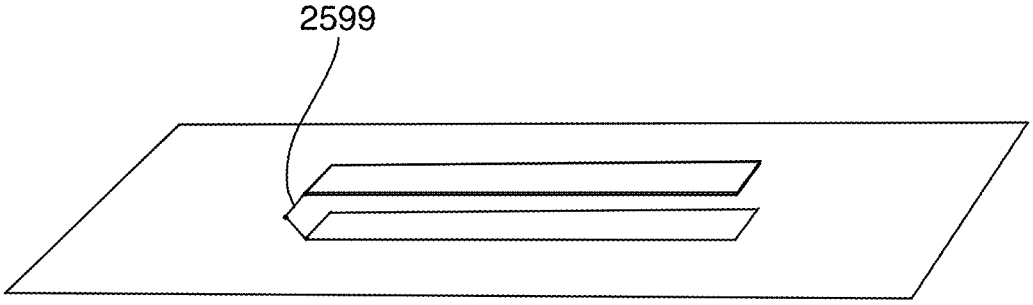
FIG. 25 illustrates an embodiment of a side bridge.

Please refer to FIG. 25. An attachable cover for covering the center opening of the light body further including at least a side bridge 2599. The side bridge 2599 being foldable to close the attachable cover on a side of an edge of the light base connecting to the attachable cover when detaching the attachable cover.

In some embodiments, the top light is emitted on a surface for providing an indirect illuminance source.

In some embodiments, the middle light body is a light tube with a top surface for passing the top light and with a bottom surface for passing the bottom light.

There are multiple LED modules disposed on an elongated substrate in the light tube for emitting the top light and the bottom light.

In some embodiments, there are two sets of LED modules disposed on opposite sides of the elongated substrate. One set emits the top light and the other set emits the bottom light.

In some embodiments, the first side light body and the second side light body 1288 are light tubes with LED modules.

In some embodiments, the first side light body and the second side light body respectively have main light directions, e.g. 120 degrees wide major light output angle.

By rotating the first side light body and/or the second side light body for changing light directions of the first lateral light and the second lateral light ensures more complete or specific areas are illuminated.

In some embodiments, a driver circuit is also integrated in the light base. Specifically, an indoor power like a 110V or 220V alternating current is connected to the driver circuit. The driver circuit converts the indoor power to proper direct currents and supplies the direct currents to the middle light body, the first side light body and the second side light body.

The electricity connection between the first end box and the second end box to the light body is a wireless power transmission.

For example, there are shifting structures in the first end box and the second end box for moving the first side light body and the second side light body horizontally.

The switch command may be a turn-on or a turn-off command. For example, the switch may be a wall switch connects to the lighting apparatus. When users turn on or turn off the wall switch, the wall switch sends the switch command to the light body.

The driver circuit in the light body detects the turn-on or turn-off commands and then automatically drives the motor to move the first side light body and the second side light body to change positions along a predetermined pattern.

For example, when the lighting apparatus is turn-on, the first side light body and the second side body are moved to expand an overall size of the lighting apparatus. Specifically, the first side light body on the left is moved further to left direction and the second side light body on the right is moved further to right direction to expand.

On the other hand, when users turn off the lighting apparatus, the driver circuit may control the motor to recover the positions of the first side light body and the second side light body.

The switch command may be a turn-on or a turn-off command. For example, the switch may be a wall switch connects to the lighting apparatus. When users turn on or turn off the wall switch, the wall switch sends the switch command to the light body.

The driver circuit in the light body detects the turn-on or turn-off commands and then automatically drives the motor to move the first side light body and the second side light body to change positions along a predetermined pattern.

For example, when the lighting apparatus is turn-on, the first side light body and the second side body are moved to expand an overall size of the lighting apparatus. Specifically, the first side light body on the left is moved further to left direction and the second side light body on the right is moved further to right direction to expand.

On the other hand, when users turn off the lighting apparatus, the driver circuit may control the motor to recover the positions of the first side light body and the second side light body.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus, comprising:

a light base having a main body and a center opening located in a middle place of the main body;

a middle light body connected to the light base for emitting a top light passing through the center opening of the light base and for emitting a bottom light in a direction opposite to the top light;

a first end box;

a second end box, the first end box and the second end box being attached to two opposite ends of the light body;

a first side light body connected to the first end box and the second end box for emitting a first lateral light; and a second side light body connected to the first end box and the second end box for emitting a second lateral light, the first side light body and the second light body are located on two opposite sides of the middle light body, wherein the first side light body and the second side light body are rotatable with respect to the first end box and the second end box for adjusting light emitting angles of the first lateral light and the second lateral light.

2. The lighting apparatus of claim 1, wherein the light base has a conductive path for routing electricity from an external power source to the middle light body, the first side light body and the second side light body.

3. The lighting apparatus of claim 2, wherein the first end box and the second end box receive electricity from the conductive path of the light base and supply the electricity to the first side light body and the second side light body.

4. The lighting apparatus of claim 1, further comprising a plurality of LED light sources disposed at a bottom of the light base.

5. The lighting apparatus of claim 1, wherein in addition to rotate with respect to the first end box and the second end box, the first side light body and the second side light body are operable to be moved closer or farther to the middle light body.

6. The lighting apparatus of claim 5, further comprising a motor for moving the first side light body and the second side light body when a switch receives a switch command.

7. The lighting apparatus of claim 1, further comprising a motor for rotating the first side light body and the second side light body when a switch receives a switch command.

8. The lighting apparatus of claim 1, wherein the main light body has an attachable cover attached to the main light body, the attachable cover further comprises multiple installation holes separated in equal distance for installing light bulbs.

9. The lighting apparatus of claim 8, wherein the multiple installation holes have a connecting basement connected to the light bulb and an installation basement connected to the attachable cover, the connecting basement and the installation basement each have an elastic portion to connect together, the connecting basement with the light bulb is detachable from the installation basement, the connecting basement has a stretching wire for hanging the light bulb, and for transmitting a power to the light bulb to emit light.

10. The lighting apparatus of claim 9, wherein the stretching wire has multiple positioning grooves for bending and to fastened a light emitting direction of the light bulb.

11. The lighting apparatus of claim 1, wherein the first side light body and the second side light body have at least an inner bucket structure for installing a standard light tube.

12. The lighting apparatus of claim 11, wherein the first side light body and the second side light body respectively have multiple separated pieces combined together, the multiple separated pieces are connected together by a plurality of elastic strings, the multiple separated pieces are dispersed out for a wider light emitting area.

13. The lighting apparatus of claim 12, wherein the multiple separated pieces have an edge space to connect each other, the edge space is overlapped with another edge space for connecting the multiple separated pieces, a total thickness of the edge space and the other edge space is same with the multiple separated pieces.

14. The lighting apparatus of claim 1, wherein the middle light body contains a standard light tube, the standard light tube is capable of being installed to a standard light tube bracket.

15. The lighting apparatus of claim 14, wherein the first side light body and the second side light body respectively contain a standard light tube.

16. The lighting apparatus of claim 1, wherein an edge of the light base connected to an attachable cover covering the center opening of the main light body further comprises two elastic buckle sheets, the elastic buckle sheets being moved out when the attachable cover are detached from the light base for connecting the middle light body to the light base, the elastic buckle sheets are hidden in the light base when the attachable cover being connected to the light base.

17. The lighting apparatus of claim 1, wherein the first end box and the second end box further comprise a light rendering demonstrate device showing a light rendering level of an environment for controlling an intensity of exposure, the light rendering demonstrate device has a sensor to sense the intensity of exposure in the environment.

18. The lighting apparatus of claim 17, wherein the light rendering demonstrate device has a light receiving board for receiving an environment light and transmits the environment light into a lighting power, the lighting power provides an instruction light on the light rendering demonstrate device when the environment light is low.

19. The lighting apparatus of claim 1, wherein an attachable cover for covering the center opening of the main light body further comprising at least a side bridge, the side bridge being foldable to close the attachable cover on a side of an edge of the light base connecting to the attachable cover when detaching the attachable cover.

20. The lighting apparatus of claim 1, wherein the top light is emitted on a surface for providing an indirect illuminance source.

* * * * *